US011783703B2

(12) United States Patent
Kaita et al.

(10) Patent No.: US 11,783,703 B2
(45) Date of Patent: Oct. 10, 2023

(54) TRAFFIC SIGNAL CONTROL SYSTEM AND IN-VEHICLE CONTROLLER

(71) Applicant: TOYOTA JIDOSHA KABUSHIKI KAISHA, Toyota (JP)

(72) Inventors: Keiji Kaita, Miyoshi (JP); Takahiko Hirasawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/808,207

(22) Filed: Jun. 22, 2022

(65) Prior Publication Data

US 2023/0031158 A1 Feb. 2, 2023

(30) Foreign Application Priority Data

Jul. 27, 2021 (JP) ..... 2021-122171

(51) Int. Cl.
*G08G 1/087* (2006.01)
*G08G 1/015* (2006.01)

(52) U.S. Cl.
CPC ..... *G08G 1/087* (2013.01)

(58) Field of Classification Search
None
See application file for complete search history.

(56) References Cited

U.S. PATENT DOCUMENTS

2002/0059017 A1 5/2002 Yamane et al.
2019/0114843 A1 4/2019 Mølmann et al.
2019/0257666 A1* 8/2019 Kreter ..... G06T 19/006
2020/0133267 A1 4/2020 Bhat et al.
2020/0372793 A1 11/2020 Weizman

FOREIGN PATENT DOCUMENTS

JP 2002-123894 A 4/2002

* cited by examiner

*Primary Examiner* — John F Mortell
(74) *Attorney, Agent, or Firm* — Finnegan, Henderson, Farabow, Garrett & Dunner, LLP.

(57) ABSTRACT

A traffic signal control system includes a processor configured to adjust a green time of a traffic signal based on vehicle class information on each of vehicles of a vehicle group approaching an intersection. The vehicle class information indicates whether the vehicle is an environmentally friendly vehicle or an environmentally unfriendly vehicle that is not the environmentally friendly vehicle.

4 Claims, 2 Drawing Sheets

TRAFFIC SIGNAL CONTROL SYSTEM AND IN-VEHICLE CONTROLLER

CROSS-REFERENCE TO RELATED APPLICATION

This application claims priority to Japanese Patent Application No. 2021-122171 filed on Jul. 27, 2021, incorporated herein by reference in its entirety.

BACKGROUND

1. Technical Field

The disclosure relates to a traffic signal control system and an in-vehicle controller.

2. Description of Related Art

There has been suggested a technology of this type, which, when a controller that controls a probe vehicle leading running vehicles executes a traffic signal control strategy for not dividing a vehicle group, including the probe vehicle as a lead vehicle, due to a red signal, extends the green time such that a traffic signal is green at the time when the vehicle group enters an intersection (see, for example, Japanese Unexamined Patent Application Publication No. 2002-123894 (JP 2002-123894 A)).

SUMMARY

The controller sets the green time of a traffic signal at an intersection without consideration of the environmental load of each vehicle of a vehicle group. For this reason, control over the traffic flow of a vehicle group in consideration of the environmental load is not achieved.

The disclosure provides a traffic signal control system and an in-vehicle controller that are capable of controlling the traffic flow of a vehicle group in consideration of the environmental load.

A first aspect of the disclosure relates to a traffic signal control system. The traffic signal control system includes a processor configured to adjust a green time of a traffic signal based on vehicle class information on each of vehicles of a vehicle group approaching an intersection. The vehicle class information indicates whether the vehicle is an environmentally friendly vehicle or an environmentally unfriendly vehicle that is not the environmentally friendly vehicle.

With the traffic signal control system according to the above aspect, the green time of the traffic signal is adjusted based on the vehicle class information on each of the vehicles of the vehicle group approaching the intersection. The vehicle class information indicates whether the vehicle is an environmentally friendly vehicle (the environmental load is relatively low) or an environmentally unfriendly vehicle (the environmental load is relatively high) that is not the environmentally friendly vehicle. Thus, it is possible to set the green time of a traffic signal in consideration of the environmental load of each vehicle of a vehicle group. As a result, it is possible to control the traffic flow of a vehicle group in consideration of the environmental load of each vehicle of the vehicle group.

In the traffic signal control system according to the above aspect, the environmentally friendly vehicles may include a battery electric vehicle, a hybrid electric vehicle, and a fuel cell electric vehicle, and the environmentally unfriendly vehicles may include an engine vehicle. In this case, the environmentally friendly vehicles may be vehicles that further meet at least one of an efficiency requirement that an energy efficiency of the vehicle is higher than or equal to a predetermined efficiency and a vehicle weight requirement that a vehicle weight is less than or equal to a predetermined vehicle weight. In this way, each of the vehicles is able to be classified as an environmentally friendly vehicle or an environmentally unfriendly vehicle.

In the traffic signal control system according to the above aspect, the processor may be configured to control the traffic signal such that the green time of the traffic signal is longer when an environmentally friendly vehicle ratio, which is a ratio of the number of the environmentally friendly vehicles to the sum of the number of the environmentally friendly vehicles and the number of the environmentally unfriendly vehicles, is low than the green time of the traffic signal when the environmentally friendly vehicle ratio is high. Thus, it is possible to reduce the amount of exhaust gas emission of the entire vehicle group of which the environmentally friendly vehicle ratio is low and reduce the environmental load as a whole.

In the traffic signal control system according to the above aspect, the processor may be configured to adjust the green time of the traffic signal based on the vehicle class information on each of the vehicles of the vehicle group only when a traffic congestion level is higher than or equal to a predetermined level.

A second aspect of the disclosure relates to an in-vehicle controller. The in-vehicle controller is mounted on a vehicle and configured to transmit the vehicle class information on the vehicle to the traffic signal control system according to the above aspect. Thus, with the traffic signal control system according to the aspect of the disclosure, the green time of the traffic signal is able to be adjusted based on the vehicle class information on each of the vehicles of the vehicle group approaching the intersection. The vehicle class information indicates whether the vehicle is an environmentally friendly vehicle (the environmental load is relatively low) and an environmentally unfriendly vehicle (the environmental load is relatively high) that is not the environmentally friendly vehicle.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

An embodiment of the disclosure will be described.

Figure 1:
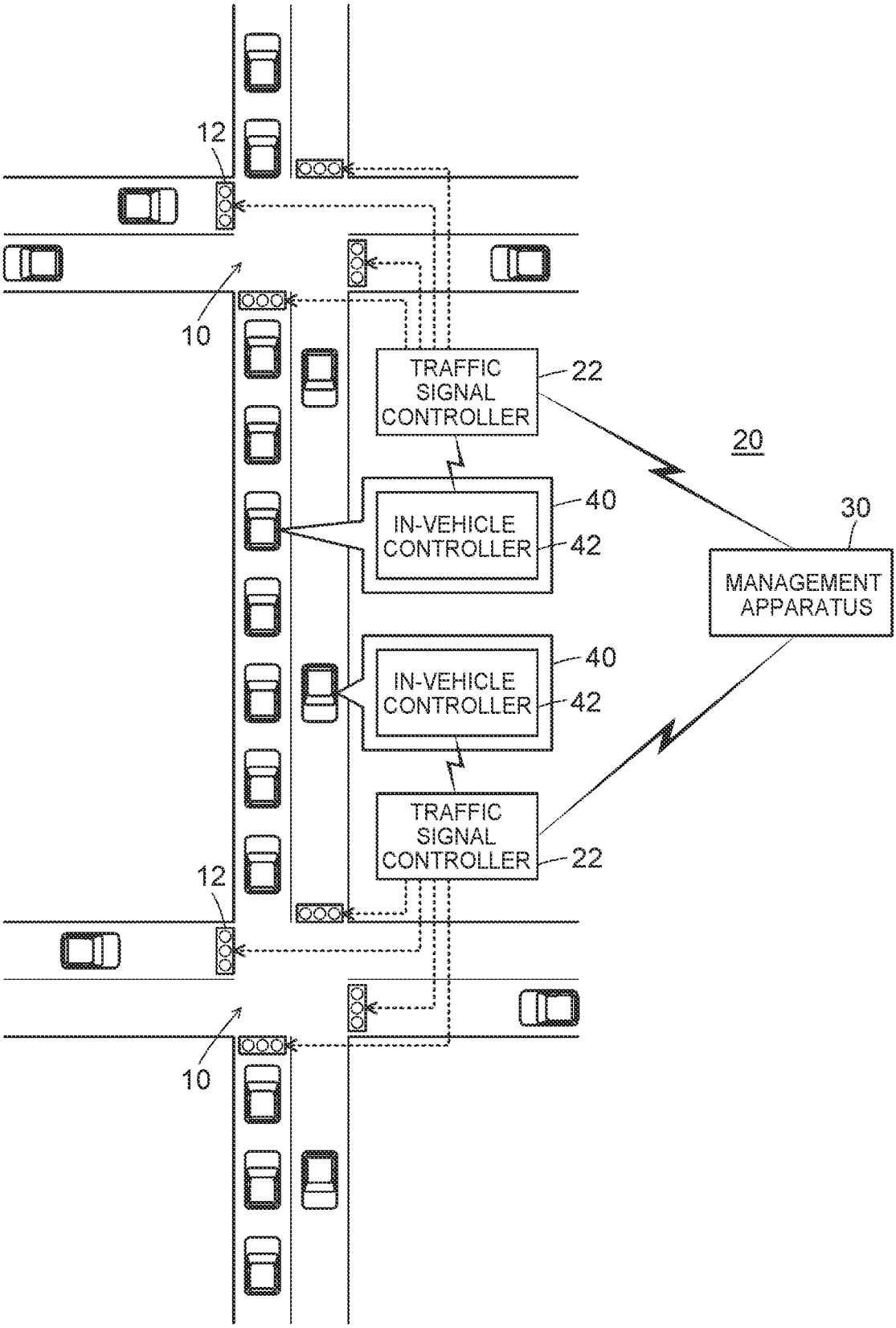
FIG. 1 is a configuration diagram showing an example of a traffic signal control system according to an embodiment of the disclosure.

FIG. 1 is a configuration diagram showing an example of a traffic signal control system 20 according to the embodiment of the disclosure. The traffic signal control system 20 according to the embodiment includes a plurality of traffic signal controllers 22 and a management apparatus 30.

Although not shown in the drawing, each of the traffic signal controllers 22 includes a microcomputer including a central processing unit (CPU) (CPU is an example of a processor), a read-only memory (ROM), a random-access memory (RAM), a flash memory, input and output ports, a communication port, and the like. Each of the traffic signal controllers 22 controls a plurality of (four in FIG. 1) traffic signals 12 disposed at a corresponding intersection 10. Here, the intersections 10 include not only a cross road (four-way junction) but also a three-way junction, a five-way junction, a rotary intersection, and the like. For the sake of easy description, the cross road intersections 10 will be described in the embodiment. Each of the traffic signal controllers 22 is capable of wirelessly communicating with the in-vehicle controller 42 of each vehicle 40 and the management apparatus 30. Each vehicle 40 is configured as an engine vehicle, a battery electric vehicle, a hybrid electric vehicle, or a fuel cell electric vehicle that runs by using power from an engine and/or a motor and includes the in-vehicle controller 42 that controls the vehicle 40. Although not shown in the drawing, the in-vehicle controller 42 includes a microcomputer including a CPU, a ROM, a RAM, a flash memory, input and output ports, a communication port, and the like. The in-vehicle controller 42 is capable of communicating with the traffic signal controller 22. The in-vehicle controller 42 transmits vehicle class information or the like to the traffic signal controller 22 corresponding to the intersection 10 in the traveling direction. The vehicle class information includes type information on the type of a vehicle (engine vehicle, battery electric vehicle, hybrid electric vehicle, or fuel cell electric vehicle), efficiency information on vehicle energy efficiency v, vehicle weight information on vehicle weight Mv, and the like. The vehicle energy efficiency $\eta v$ is, for example, fuel efficiency for an engine vehicle, a hybrid electric vehicle, and a fuel cell electric vehicle, or electric power efficiency for a battery electric vehicle. The vehicle energy efficiency $\eta v$ and the vehicle weight Mv may be specification values of the vehicle 40 or may be estimated values periodically estimated.

Although not shown in the drawing, the management apparatus 30 includes a computer including a CPU, a ROM, a RAM, a flash memory, input and output ports, a communication port, and the like, and a storage device, such as a hard disk drive and a solid state drive (SSD). The management apparatus 30 is capable of wirelessly communicating with the traffic signal controllers 22.

Figure 2:
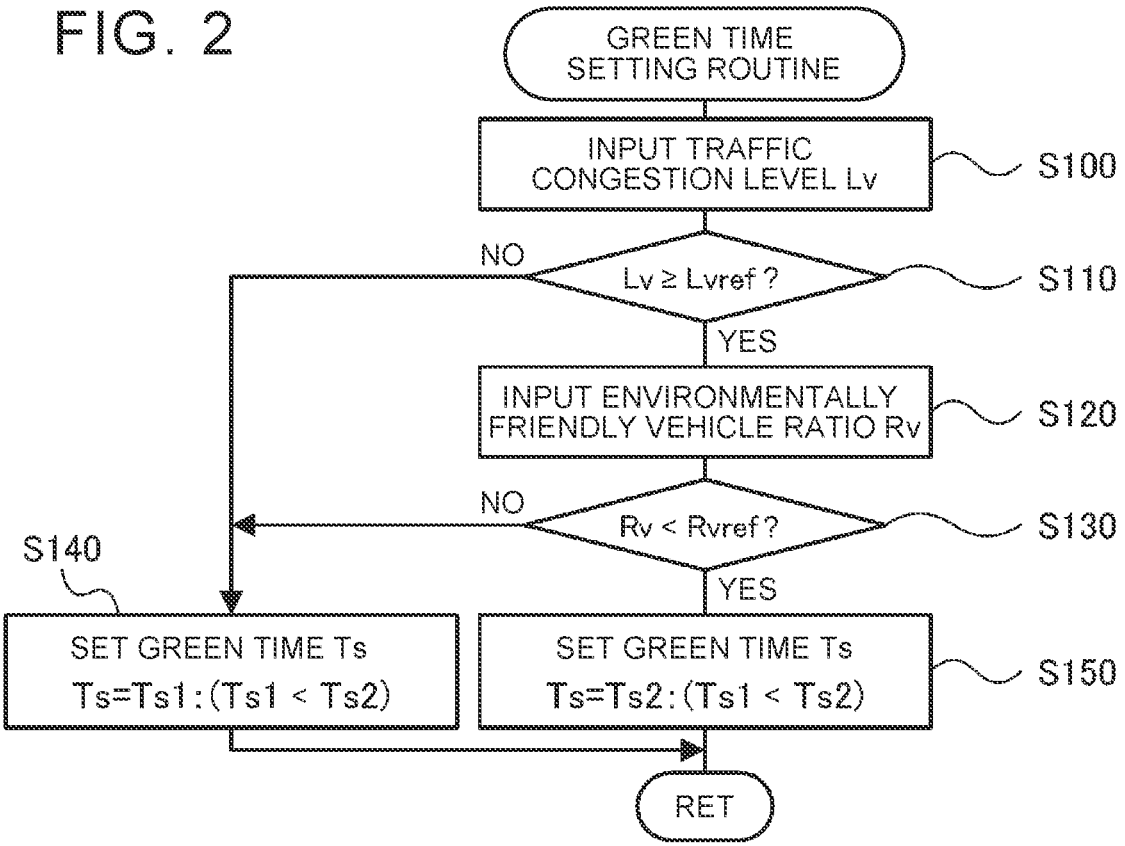
FIG. 2 is a flowchart showing an example of a green time setting routine that is executed by a management apparatus.

Next, the operation of the thus configured traffic signal control system 20 will be described. FIG. 2 is a flowchart showing an example of a green time setting routine that is executed by the management apparatus 30. The routine is repeatedly executed for each of the intersections 10 while a target direction that is a target traveling direction is switched among a plurality of roads connected to the intersection 10 (for example, the target direction is switched in order of upward direction, downward direction, left-hand direction, and right-hand direction of FIG. 1).

When the green time setting routine of FIG. 2 is executed, the management apparatus 30 initially inputs a traffic congestion level Lv in the target direction around the intersection 10 (step S100). Here, the traffic congestion level Lv is input from an information center or the like by communication.

Subsequently, the management apparatus 30 determines whether the traffic congestion level Lv in the target direction around the intersection 10 is higher than or equal to a threshold Lvref (step S110). Here, the threshold Lvref is a threshold used to determine whether the traffic congestion level Lv is high to some extent. When the management apparatus 30 determines that the traffic congestion level Lv in the target direction around the intersection 10 is lower than the threshold Lvref, the management apparatus 30 sets a normal time Ts1 for a green time Ts of the traffic signals 12 in the target direction and in a direction opposite to the target direction at the intersection 10 (step S140) and ends the routine. The management apparatus 30 periodically transmits the green time Ts in each traveling direction at the intersection 10 to the traffic signal controller 22 corresponding to the intersection 10. The traffic signal controller 22 controls the traffic signals 12 by using the green time Ts in each traveling direction from the management apparatus 30. In this way, the traffic flow of a vehicle group is controlled.

When the management apparatus 30 determines in step S110 that the traffic congestion level Lv in the target direction around the intersection 10 is higher than or equal to the threshold Lvref, the management apparatus 30 inputs an environmentally friendly vehicle ratio Rv within a predetermined distance (for example, about 100 m) before the intersection 10 in the target direction (step S120). In the embodiment, the management apparatus 30 classifies each of the vehicles 40 as an environmentally friendly vehicle or an environmentally unfriendly vehicle that is not an environmentally friendly vehicle based on information received via the traffic signal controller 22 from the in-vehicle controller 42 of the vehicle 40. The environmentally friendly vehicles include a battery electric vehicle, a hybrid electric vehicle, and a fuel cell electric vehicle. The environmentally unfriendly vehicles include an engine vehicle. A value computed as the ratio of the number of environmentally friendly vehicles to the number of vehicles (the sum of the number of environmentally friendly vehicles and the number of environmentally unfriendly vehicles) is input as the environmentally friendly vehicle ratio Rv.

Subsequently, the management apparatus 30 determines whether the environmentally friendly vehicle ratio Rv is lower than a threshold Rvref (step S130). Here, the threshold Rvref is a threshold used to determine whether the environmentally friendly vehicle ratio Rv is relatively low. When the management apparatus 30 determines that the environmentally friendly vehicle ratio Rv is higher than or equal to the threshold Rvref, the management apparatus 30 sets the time Ts1 for the green time Ts of the traffic signals 12 in the target direction and in the direction opposite to the target direction at the intersection 10 (step S140) and ends the routine. On the other hand, when the management apparatus 30 determines that the environmentally friendly vehicle ratio Rv is lower than the threshold Rvref, the management apparatus 30 sets a time Ts2 longer by a time ATs than the time Ts1 for the green time Ts of the traffic signals 12 in the target direction and in the direction opposite to the target direction at the intersection 10 (step S150) and ends the routine. Here, the time ATs may be a constant time or may be a time that extends as the environmentally friendly vehicle ratio Rv decreases with respect to the threshold Rvref.

When the traffic congestion level Lv is low or when the number of environmentally friendly vehicles is large (the environmentally friendly vehicle ratio Rv is high) even when the traffic congestion level Lv is high, it is estimated that the amount of exhaust gas emission of the entire vehicle group within the predetermined distance before the intersection 10 in the target direction is not so large; however, when the traffic congestion level Lv is high and the number of environmentally unfriendly vehicles is large (the environmentally friendly vehicle ratio Rv is low), the amount of exhaust gas emission of the entire vehicle group is relatively large, it is estimated that it is not desirable for the environment. Accordingly, in the embodiment, when the traffic congestion level Lv in the target direction around the intersection 10 is higher than or equal to the threshold Lvref and the environmentally friendly vehicle ratio Rv within the predetermined distance before the intersection 10 in the target direction is lower than the threshold Rvref, the green time Ts of the traffic signals 12 in the target direction and in the direction opposite to the target direction at the intersection 10 is extended as compared to when the traffic congestion level Lv is lower than the threshold Lvref or when the traffic congestion level Lv is higher than or equal to the threshold Lvref and the environmentally friendly vehicle ratio Rv is higher than or equal to the threshold Rvref. Thus, it is possible to reduce the amount of exhaust gas emission of the entire vehicle group of which the environmentally friendly vehicle ratio Rv is low and reduce the environmental load as a whole.

With the traffic signal control system 20 according to the above-described embodiment, when the traffic congestion level Lv in the target direction around the intersection 10 is higher than or equal to the threshold Lvref and the environmentally friendly vehicle ratio Rv within the predetermined distance before the intersection 10 in the target direction is lower than the threshold Rvref, the management apparatus 30 extends the green time Ts of the traffic signals 12 in the target direction and in the direction opposite to the target direction at the intersection 10 as compared to when the environmentally friendly vehicle ratio Rv is higher than or equal to the threshold Rvref. Thus, it is possible to reduce the amount of exhaust gas emission of the entire vehicle group of which the environmentally friendly vehicle ratio Rv is low and reduce the environmental load as a whole.

With the traffic signal control system 20 according to the above-described embodiment, when the environmentally friendly vehicle ratio Rv within the predetermined distance before the intersection 10 in the target direction is lower than the threshold Rvref, the management apparatus 30 extends the green time Ts of the traffic signals 12 in the target direction and in the direction opposite to the target direction at the intersection 10 as compared to when the environmentally friendly vehicle ratio Rv is higher than or equal to the threshold Rvref. Alternatively, at the intersection 10, between a pair of the target direction and the direction opposite to the target direction (for example, the upward direction and the downward direction in FIG. 1) and the other pair of directions (for example, the left-hand direction and the right-hand direction in FIG. 1), the green time Ts of the traffic signals 12 in the pair of directions in which the environmentally friendly vehicle ratio Rv is low may be made longer than the green time Ts of the traffic signals 12 in the pair of directions in which the environmentally friendly vehicle ratio Rv is high.

Figure 3:
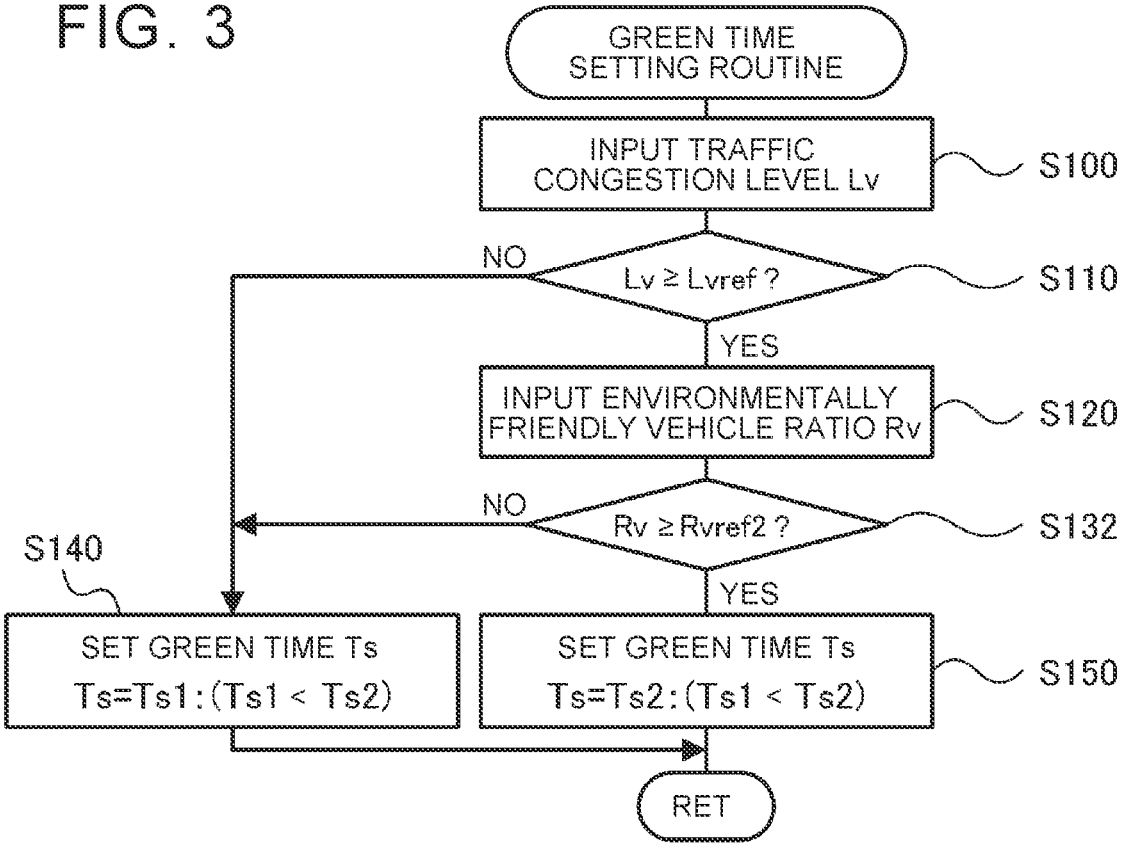
FIG. 3 is a flowchart showing another example of a green time setting routine that is executed by the management apparatus.

With the traffic signal control system 20 according to the embodiment, the management apparatus 30 executes the green time setting routine of FIG. 2. Alternatively, the management apparatus 30 may execute the green time setting routine of FIG. 3. The green time setting routine of FIG. 3 is the same as the green time setting routine of FIG. 2 except that the process of step S130 is replaced with the process of step S132. Therefore, like step numbers in the green time setting routine of FIG. 3 denote the same processes of the green time setting routine of FIG. 2, and the detailed description thereof is omitted.

In the green time setting routine of FIG. 3, when the management apparatus 30 inputs the environmentally friendly vehicle ratio Rv in step S120, the management apparatus 30 determines whether the input environmentally friendly vehicle ratio Rv is higher than or equal to a threshold Rvref2 (step S132). Here, the threshold Rvref2 is a threshold used to determine whether the environmentally friendly vehicle ratio Rv is relatively high. When the management apparatus 30 determines that the environmentally friendly vehicle ratio Rv is lower than the threshold Rvref2, the management apparatus 30 sets the time Ts1 for the green time Ts of the traffic signals 12 in the target direction and in the direction opposite to the target direction at the intersection 10 (step S140) and ends the routine. On the other hand, when the management apparatus 30 determines that the environmentally friendly vehicle ratio Rv is higher than or equal to the threshold Rvref2, the management apparatus 30 sets the time Ts2 longer by the time ATs than the time Ts1 for the green time Ts of the traffic signals 12 in the target direction and in the direction opposite to the target direction at the intersection 10 (step S150) and ends the routine. In this case, the time ATs may be a constant time or may be a time that extends as the environmentally friendly vehicle ratio Rv increases with respect to the threshold Rvref2.

In this modification, when the management apparatus 30 sets the green time Ts of the traffic signals 12 in the target direction and in the direction opposite to the target direction at the intersection 10 based on the result of comparison between the environmentally friendly vehicle ratio Rv and the threshold Rvref2, the management apparatus 30 transmits an instruction to inform the reason together when the management apparatus 30 transmits the green time Ts to the traffic signal controller 22. Then, the traffic signal controller 22 controls the traffic signals 12 by using the green time Ts and, where necessary, shows the reason for the green time Ts, for example, a message, such as "Because the environmentally friendly vehicle ratio is high, the green time is extended.", on a display of each of the vehicles 40 (at least environmentally unfriendly vehicles). With this configuration, it is possible to reduce the environmental load by facilitating drivers of environmentally unfriendly vehicles to purchase environmentally friendly vehicles.

In the traffic signal control system 20 according to the modification, in the green time setting routine of FIG. 3, when the environmentally friendly vehicle ratio Rv within the predetermined distance before the intersection 10 in the target direction is higher than or equal to the threshold Rvref2, the management apparatus 30 extends the green time Ts of the traffic signals 12 in the target direction and in the direction opposite to the target direction at the intersection 10 as compared to when the environmentally friendly vehicle ratio Rv is lower than the threshold Rvref2. Alternatively, at the intersection 10, between a pair of the target direction and the direction opposite to the target direction (for example, the upward direction and the downward direction in FIG. 1) and the other pair of directions (for example, the left-hand direction and the right-hand direction in FIG. 1), the green time Ts of the traffic signals 12 in the pair of directions in which the environmentally friendly vehicle ratio Rv is high may be made longer than the green time Ts of the traffic signals 12 in the pair of directions in which the environmentally friendly vehicle ratio Rv is low.

With the traffic signal control system 20 according to the embodiment or the above-described modification, the management apparatus 30 assumes a battery electric vehicle, a hybrid electric vehicle, and a fuel cell electric vehicle as environmentally friendly vehicles and vehicles other than the environmentally friendly vehicles as environmentally unfriendly vehicles in computing the environmentally friendly vehicle ratio Rv in the green time setting routine of FIG. 2 or FIG. 3. Alternatively, a battery electric vehicle, a hybrid electric vehicle, and a fuel cell electric vehicle that meet the efficiency requirement that the vehicle energy efficiency ηv is higher than or equal to a threshold ηvref may be assumed as environmentally friendly vehicles, a battery electric vehicle, a hybrid electric vehicle, and a fuel cell electric vehicle that meet the vehicle weight requirement that the vehicle weight Mv is less than or equal to a threshold Mvref may be assumed as environmentally friendly vehicles, or a battery electric vehicle, a hybrid electric vehicle, and a fuel cell electric vehicle that meet the efficiency requirement and the vehicle weight requirement may be assumed as environmentally friendly vehicles.

In the traffic signal control system 20 according to the embodiment or the above-described modification, the management apparatus 30 sets the green time Ts of the traffic signals 12 in the target direction and in the direction opposite to the target direction at the intersection 10 by using the traffic congestion level Lv in the target direction around the intersection 10 and the environmentally friendly vehicle ratio Rv within the predetermined distance before the intersection 10 in the target direction in the green time setting routine of FIG. 2 or FIG. 3. Alternatively, the green time Ts of the traffic signals 12 may be set by using only the environmentally friendly vehicle ratio Rv without using the traffic congestion level Lv.

In the traffic signal control system 20 according to the embodiment or the above-described modification, the management apparatus 30 executes the green time setting routine of FIG. 2 or FIG. 3 for each of the intersections 10. Alternatively, each of the traffic signal controllers 22 may execute the green time setting routine of FIG. 2 or FIG. 3 for a corresponding one of the intersections 10.

The correspondence relation between major elements of the embodiment and major elements of the disclosure described in Summary does not limit the elements of the disclosure described in the Summary since the embodiment is an example for specifically describing the aspects of the disclosure described in the Summary. In other words, the aspects of the disclosure described in the Summary should be interpreted based on the description therein, and the embodiment is only a specific example of the aspects of the disclosure described in the Summary.

The embodiment of the disclosure has been described above; however, the disclosure is not limited to the embodiment and may be, of course, modified into various forms without departing from the scope of the disclosure.

The disclosure is usable in the industry of manufacturing traffic signal control systems and in-vehicle controllers.

What is claimed is:

1. A traffic signal control system comprising a processor configured to adjust a duration during which a traffic signal is green based on vehicle class information of each vehicle of a group of vehicles approaching an intersection, the vehicle class information indicating whether the vehicle meets an efficiency requirement that an energy efficiency of the vehicle is higher than or equal to a predetermined efficiency, wherein the processor is configured to control the traffic signal such that the duration during which the traffic signal is green is longer when a ratio of the number of the vehicles meeting the efficiency requirement to the sum of the vehicles is low, than when the ratio is high.

2. The traffic signal control system according to claim 1, wherein the vehicles meeting the efficiency requirement further meet a vehicle weight requirement that a vehicle weight is less than or equal to a predetermined vehicle weight.

3. The traffic signal control system according to claim 1, wherein the processor is configured to adjust the duration during which the traffic signal is green based on the vehicle class information of each vehicle of the group of vehicles only when a traffic congestion level is higher than or equal to a predetermined level.

4. An in-vehicle controller mounted on a vehicle and configured to transmit the vehicle class information on the vehicle to the traffic signal control system according to claim 1.

* * * * *